US009127211B2

(12) United States Patent
Bhirud

(10) Patent No.: US 9,127,211 B2
(45) Date of Patent: Sep. 8, 2015

(54) ETHYLENE FURNACE DECOKING METHOD

(75) Inventor: Vasant Lotu Bhirud, Katy, TX (US)

(73) Assignee: SBT TECHNOLOGY, INC., Houston, TX (US)

( * ) Notice: Subject to any disclaimer, the term of this patent is extended or adjusted under 35 U.S.C. 154(b) by 266 days.

(21) Appl. No.: 13/615,554

(22) Filed: Sep. 13, 2012

(65) Prior Publication Data

US 2013/0239999 A1 Sep. 19, 2013

Related U.S. Application Data

(60) Provisional application No. 61/533,812, filed on Sep. 13, 2011.

(51) Int. Cl.
*C10G 9/16* (2006.01)

(52) U.S. Cl.
CPC ..... *C10G 9/16* (2013.01)

(58) Field of Classification Search
None
See application file for complete search history.

(56) References Cited

U.S. PATENT DOCUMENTS 2,893,941 A * 7/1959 Kohfeldt et al. ..... 208/48 R
3,365,387 A * 1/1968 Cahn et al. ..... 208/106
3,617,479 A * 11/1971 King et al. ..... 208/48 AA
6,772,771 B2 * 8/2004 Cai et al. ..... 134/22.16

* cited by examiner

*Primary Examiner* — Nicole Blan
(74) *Attorney, Agent, or Firm* — Triantaphyllis Law Firm

(57) ABSTRACT

A method for decoking radiant coils and quench exchangers in ethylene furnaces is disclosed. A chemical mixture containing a metal hydroxide and a metal carbonate is combined with steam to decoke an ethylene furnace.

17 Claims, 1 Drawing Sheet

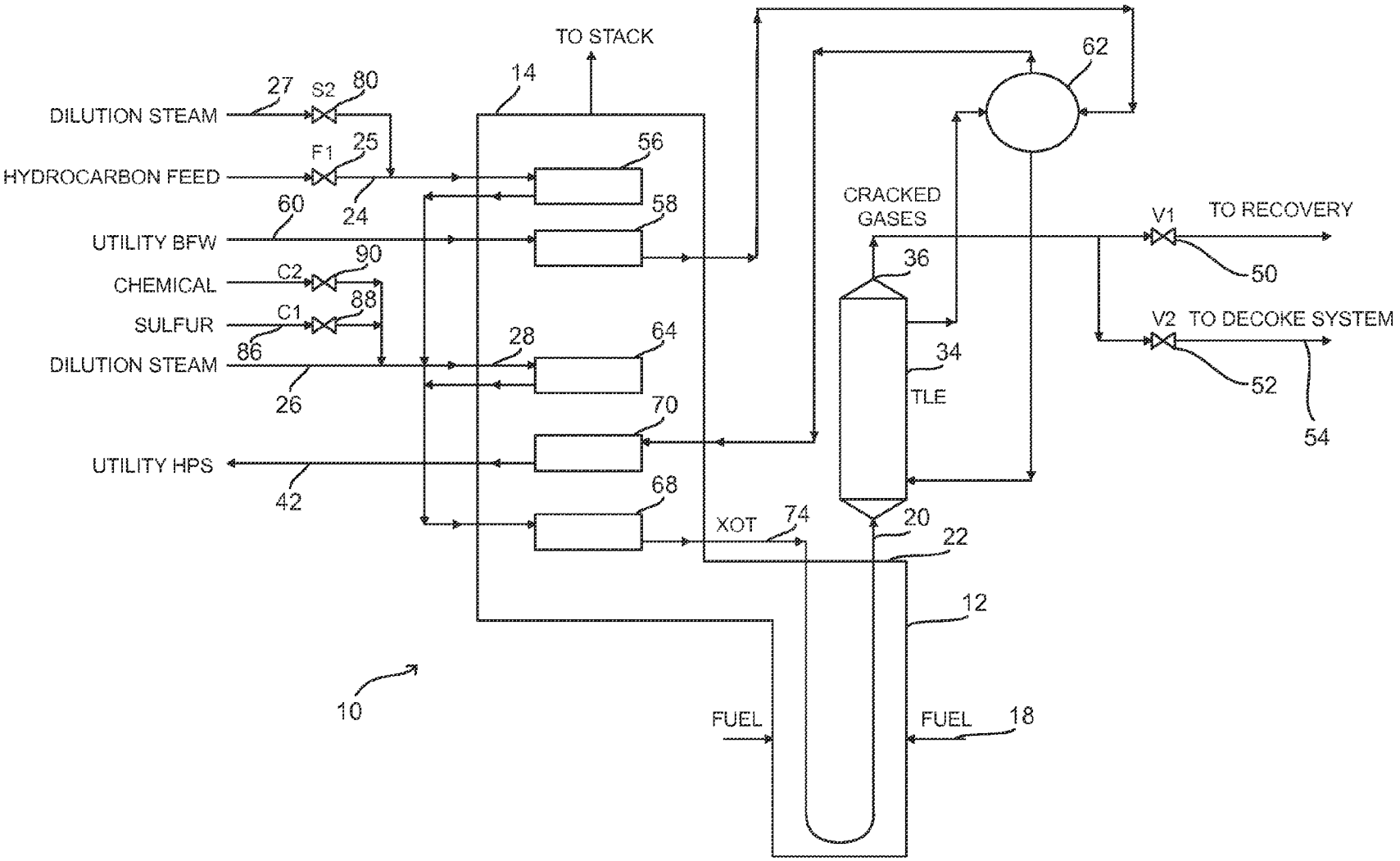
TO RECOVERY
TO DECOKE SYSTEM
V1
V2
50
52
54
62
CRACKED GASES
36
34
TLE
20
22
12
18
FUEL
74
XOT
FUEL
TO STACK
14
56
58
64
70
68
28
10
80
S2
25
F1
24
90
C2
88
C1
27
60
86
26
42
DILUTION STEAM
HYDROCARBON FEED
UTILITY BFW
CHEMICAL
SULFUR
DILUTION STEAM
UTILITY HPS

ETHYLENE FURNACE DECOKING METHOD

RELATED PRIORITY DATE APPLICATION

This application claims the benefit under 35 U.S.C. 119(e) of the U.S. provisional application No. 61/533,812 filed on Sep. 13, 2011.

TECHNICAL FIELD OF THE INVENTION

The present invention relates to the field of ethylene furnaces and, more particularly, to the field of using chemicals to speed-up steam decoking of ethylene furnaces without the use of air. The decoking process is controlled by employing predetermined flow rates of steam and chemical mixture at predetermined radiant coil outlet temperature. This methodology eliminates the need of sulfiding radiant coils after steam-air decoking. The chemical mixture used in this invention is an aqueous solution of potassium hydroxide (KOH) and potassium carbonate ($K_2CO_3$). Additionally, the said procedure covers decoking of quench exchangers of both shell-and-tube and double-pipe type exchangers which are commonly used in the ethylene furnaces.

BACKGROUND OF THE INVENTION

Ethylene, an olefin compound is one of the key petrochemical compounds manufactured in large quantities around the world. It is used to manufacture consumer products like plastics, tires, automobile antifreeze, etc. While ethylene industry began by recovering ethylene from refinery by product gases, thermal cracking has become the main production method today. Over the years technology has evolved so that ethylene is produced by thermally cracking full spectrum of hydrocarbon streams such as ethane, propane, butanes, naphtha, gas oil etc.

Thermal cracking of hydrocarbons to produce ethylene is beneficial at low pressures and low reaction time. Thermal cracking of hydrocarbons is done in radiant tubes as shown in the FIG. 1. Low hydrocarbon pressure is achieved by diluting hydrocarbon stream with steam. Higher the amount of diluting steam, better the production of ethylene. Similarly smaller the tube volume, better the ethylene production. Amount of steam used in industrial practice is determined by the economics. Usually ratio of diluting steam to hydrocarbon feed ranges from about 0.3 for ethane to about 1.0 for gas oil. Desired reaction time is achieved by providing suitable combination of tube diameter and tube length. Reaction times have evolved over the years so that we can design tubes with reaction time of about 0.1 second compared to more than 0.5 seconds in the old days. Lower the reaction time higher the reaction temperature, termed as coil outlet temperature ("COT").

Another important process parameter in thermal cracking is the conversion of hydrocarbon feed. Higher the conversion of hydrocarbon feed higher the production of ethylene. However, higher the conversion of hydrocarbon feed, higher the coil outlet temperature. Since the amount of dilution steam is limited by economics technology has evolved around increasing hydrocarbon conversion and lowering reaction time. For example, thermal cracking of ethane at 55% conversion and 0.5 seconds reaction time with dilution steam to ethane ratio of 0.3 occurs at a theoretical temperature of 819° C. compared to ethane at conversion of 65% and reaction time of 0.1 seconds with same dilution steam to ethane ratio of 0.3 occurs at a theoretical temperature of 884° C., a rise of 65° C.

An industrial ethylene furnace 10 is shown in FIG. 1. Ethylene furnace 10 is divided into two sections, namely, a radian section 12 and a convection section 14. Radiant section 12 contains a bank of tubes termed as radiant coils (not shown), heated by a firing fuel 18 on the outside to achieve a desired coil outlet temperature 20 at outlet 22 for a given hydrocarbon feed and steam mixture. A hydrocarbon feed 24 flowing through valve (F1) 25 25 is mixed with a dilution steam stream 26 to form a mixture 28 that enters radiant section 12 at an incipient reaction temperature 74 and exits at a predetermined coil outlet temperature 20. For example ethane and dilution steam mixture will enter radiant section 12 at about 675° C. Flue gases from radiant section 12 exit to convection section where the heat contained in the flue gases is primarily used to heat hydrocarbon feed and steam mixture to incipient reaction temperature and balance is used to generate utility steam. Obviously incipient reaction temperature and coil outlet temperature varies with feedstock type and desired conversion.

Thermally cracked hydrocarbons termed as cracked gas and steam mixture exits radiant coils at 22 and are quenched very quickly to arrest cracking reaction at a quenching device. The quenching device is preferably a shell and tube type exchanger shown in the FIG. 1, referred to as a transfer line exchanger ("TLE") 34, where water is circulated on the outside of tubes. Alternately, a quenching device can be a double pipe exchanger, which is somewhat expensive. The quenched cracked gas and steam mixture exits transfer line exchanger 34 at 36 and is sent to a recovery section via a line 40 where ethylene and other products are separated. Heat recovered in transfer line exchanger 34 enhances utility steam generation when combined with heat available in convection section 14 to generate utility high pressure steam 42. Normally there are quite a few radiant coils and correspondingly appropriate number of transfer line exchangers. The method described and claimed in this invention can be performed in any ethylene furnace 10 having any type of radiant coil coupled with any type of quench exchanger.

Thermal cracking of hydrocarbons produces many by products along with coke. Coke adheres to radiant coil walls and tube walls of quench exchangers. As coke builds up on the radiant coils, efficiency of heat transfer from flue gases to hydrocarbons in the tube goes down resulting in higher and higher tube metal temperature for constant coil outlet temperature. Second consequence of the coke build up is increasing pressure drop in the radiant coils and transfer line exchanger. Ultimately a limit is reached on tube metal temperature and/or pressure drop when production must be stopped. The time between the start of production to shutdown of production due to coking is termed as furnace run length. Observed furnace run lengths are in the range of 5 to 60 days. Coking increases rapidly at higher coil outlet temperatures. Since thermal cracking technology has evolved to higher and higher coil outlet temperatures coking becomes increasingly severe as well as critical problem. Coking in transfer line exchangers can be partly due to coking and partly due to condensation of tars on the relatively colder tube walls.

In order to prepare ethylene furnace 10 for decoking, hydrocarbon feed 24 is cut off and dilution steam flow may be increased by increased flow of dilution steam 26 and/or flow of dilution steam through a line 27 maintaining a predetermined coil outlet temperature 20 with furnace steam going to the recovery section. This phase of the furnace operation is termed as "Hot Steam Stand By" (HS SB). After HS SB, valve (V1) 50 is closed and valve (V2) 52 is opened so that furnace steam will be routed to "decoke system". Once closure of valve (V1) 50 is completely confirmed, air is introduced into furnace 10 to start combustion of coke. Steam-air decoking procedures have been patented by Lohr, et al. U.S. Pat. No. 4,376,694, (1983) Sliwka et al. U.S. Pat. No. 4,420,343 (1983) and De Haan et al. U.S. Patent Application 20090020459. In principal, combustion of coke is monitored by measuring $CO_2$ in furnace 10 effluents. Combustion of coke is controlled by amount air mixed with steam. Initially air to steam ratio is small and it is increased slowly based on effluent $CO_2$ content. When effluent $CO_2$ content falls below one mole % on dry basis, coil outlet temperature is increased so that hotter steam air mixture can "vaporize" condensed tars in TLE's. Some operators perform Transfer line exchanger tar vaporization phase with air alone. Transfer line exchanger decoking may take about 15 to 30 hours. The decoking process is terminated when effluent $CO_2$ content falls below a predetermined level such as 0.1 mole % on dry basis and/or Transfer line exchanger outlet temperature stabilizes. First step after termination of the decoking is cut off air flow to furnace 10, and only steam is allowed to flow with valve (V1) 50 still closed and valve (V2) 52 open. When stoppage of air flow to furnace 10 is completely confirmed valve (V1) 50 is opened and valve (V2) 52 is closed thereby isolating "decoke system" and running furnace 10 in HSSB mode. The decoking period can vary from 12 hours to 48 hours. When furnace 10 is running in HSSB mode, predetermined rate of sulfur compound is injected into steam to passivate the radiant coils. Sulfiding may be done in 4 to 6 hours. When sulfiding is complete then furnace 10 is ready for feed introduction. This entire process is recognized as "steam-air hot decoke" method and is employed by almost all (99%) producers (van Helmond, 2009). During decoke TLE's operate at low temperatures where coke combustion is very poor and vaporization of tars is difficult to complete. As a result it becomes necessary to clean TLE's mechanically after 3-4 hot decoke cycles.

Steam-air decoking method has consequences. Since coke is combusted inside the radiant coils local hot spots are created leading to severe carburization. Carburization is greatly increased at high temperatures with low or zero amount of steam flow as employed in Transfer line exchanger decoking phase (Tillack, 1998). Very aggressive steam-air decoking is believed to be a major cause of carburization. The most helpless fact of carburization is its non-uniformity and unpredictability. Carburization is the major cause of failure of radiant coils. Difficulty in controlling air flow is described by De Haan et. al. in U.S. Patent application 20090020459.

Steam-air decoking has undesired side effect of cracking radiant tubes when the "hot spots" are uncontrollable. By the time hot spot is observed it is too late to control furnace 10 firing. Failure of radiant coils due to cracking increases maintenance costs.

Steam-air decoking method has further consequences. Due to the use of air in decoking process, metal sites on radiant coils become very active and cause high coke and carbon monoxide production (Zisman, 2000). These active sites on radiant coils need to be passivated using sulfur compounds during HSSB phase. Amount of sulfur dosage required for sulfiding can be very high. Also as radiant coil ages, tube sites become more active and require higher and higher amount of sulfur for passivation. As like carburization, sulfiding is non-uniform and unpredictable. McKimpson and Albright (2004) raise the question that can radiant coil exit, where coking occurs the heaviest, be properly sulfided? They observe that most sulfur is reacted before it reaches the radiant coil outlet portion. Improper sulfiding can lead to very high rates of coke formation during normal cracking operation.

Sulfiding has further consequences. During sulfiding phase steam is routed to recovery section via valve (V1) 50. Sulfur compounds used in the sulfiding phase can produce acidic compounds which lower quench water pH. Furthermore some sulfur compounds behave like surfactants producing a stable emulsion of quench water and gasoline which results in fouling of equipment in quench water and dilution steam circuits (Zisman, 2000, De Haan, 2006). The most unpredictable and undesirable consequence is that the dilution steam contaminated with gasoline coming to furnace 10 will cause fouling in furnace 10 convection section 14.

Sulfiding has more unintended consequences. Ethylene plants may have gasoline hydrogenation unit especially if the main hydrocarbon feed is naphtha or gas oil. Sulfur compounds injected in the sulfiding phase, if unconverted, can end up in gasoline. Sulfur in gasoline will poison gasoline hydrogenation catalyst. (De Haan, 2006).

Alternative to steam-air decoking has been the steam-only decoking procedure (Zimmermann, 2005) which is now almost a forgotten art. In steam-only decoking water gas reaction takes place to gasify coke. Water gas reaction is endothermic which does not cause hot spots in the radiant coil. As a result carburization is reduced greatly compared to steam-air decoking. Furthermore passivation of radiant coils is not required there by eliminating sulfiding altogether and its bad side effects as described above. Those who have been able to manage steam only decoking have experienced longer radiant coil life. However steam only decoking fell out of favor because it was slow even when employing difficult to manage high coil outlet temperatures of 1000° C.

Ethylene industry would greatly benefit if steam-only decoking can be made faster without significant bad side effects so that it can compete effectively with steam-air decoking and ultimately replace it.

Accelerating water gas reaction to gasify coal or coke is probably the most investigated subject matter. Application of chemicals to gasify coke in ethylene radiant tubes when furnace 10 is on line, i.e. processing hydrocarbons, has been tried. For example, Kohfeldt and Herbert in U.S. Pat. No. 2,893,941 in year 1959 proposed injecting aqueous solution of potassium carbonate ($K_2CO_3$) into gas oil and steam mixture being cracked. Coke produced by gas oil cracking in radiant coils, will gasify by potassium carbonate ($K_2CO_3$). Kohfeldt and Herbert reported success in extending furnace run length. Kohfeldt and Herbert also observed that potassium carbonate ($K_2CO_3$) reduced coking in convection section 14 banks which were operating at temperatures less than 400° C. Kohfeldt and Herbert's methodology is recognized as on-line coke control since effluents are routed to recovery area. However, this methodology was never adapted by ethylene industry probably because it would have adverse effects in the recovery area operations downstream e.g. affecting pH of quench water etc. Recently Gandman in U.S. Pat. No. 6,228,253 proposed injecting aqueous mixture of potassium carbonate and magnesium acetate in ethylene furnace radiant coil or coils where steam decoking effluent along with cracked effluents from other coils were routed to recovery area similar to Kohfeldt and Herbert. Gandman reported success in removing coke from the selected radiant coils. Stancato and De Haan in 2001 reported at the Ethylene Producers Conference, that rate of gasification of coke by Potassium carbonate ($K_2CO_3$) is 16 times the rate of gasification by steam alone.

Main products of water gas reaction are CO and $H_2$ and along with a small quantity of $CO_2$. If water-gas reaction products are sent to recovery section during decoking CO concentration will spike in the cracked gas. CO is a poison to downstream hydrogenation catalysts. Apparently some companies have tried to market variation of water-gas accelerants for on-line coke control without wide acceptance. Obviously, risk of poisoning downstream hydrogenation catalyst is too great for producers.

Proper application of water-gas reaction accelerants is in the steam decoking step where decoke effluents are routed to "decoke system" there by completely avoiding risk to recovery area operations. However, this can be accomplished only if one is versed in process parameters used in steam-only decoking. Proper marriage of steam decoking process parameters such as steam flow rate and coil outlet temperature with chemical injection rate is required to achieve success.

Patents and literature are full of many investigations of chemicals used in accelerating water-gas reaction. We researched literature to find another reasonably priced chemical which can provide synergy with potassium carbonate ($K_2CO_3$). In a comprehensive review of carbon gasification, Nand (1981) in his thesis refers work of Kayembe and Pulsifier (1976) who found that the highest steam gasification rates were achieved by potassium carbonate ($K_2CO_3$) and Potassium hydroxide (KOH).

According to the present invention, an efficient and economic process for decoking ethylene furnaces or for reducing the rate of coke deposition in ethylene furnaces is disclosed. These and other advantages of the present invention will become apparent from the following description and drawings.

SUMMARY OF THE INVENTION

According to the present invention, steam together with a chemical mixture of potassium hydroxide (KOH) and potassium carbonate ($K_2CO_3$) are injected into an ethylene furnace to gasify coke deposits. The process the preferably used when the furnace is offline. Optimum combination of steam flow rate, coil outlet temperature and chemical mixture injection rates are required for this method to complete decoking in the same or better time frame than that required by steam-air decoking Chemical assisted steam decoking is terminated when CO content in furnace 10 effluent is less than 0.1 mole % on dry basis and Transfer line exchanger outlet temperature stabilizes.

Major advantages of the method of the present invention are an efficient and non-aggressive method of decoking which can result in longer radiant coil life, constant furnace run lengths throughout the coil life and no bad side effects on recovery section processing. There are other advantages of this method which will be apparent to those skilled in the art based upon the description of preferred embodiments described.

The process can also be used when the furnace is online and is, especially effective when an ethylene furnace is first decoked offline using the method of the present invention and then is placed online. In that mode of decoking, the ethylene furnace would be able to crack hydrocarbons with the chemical mixture at levels of 10 to 50 ppmw on feed to gasify coke formed during process thereby extending furnace run length.

BRIEF DESCRIPTION OF THE DRAWINGS

For a detailed description of the preferred embodiment of the invention, reference will now be made to the accompanying drawings wherein:

FIG. 1 is a schematic of a typical ethylene furnace.

DETAILED DESCRIPTION OF THE INVENTION

As used herein the term "a furnace is online" means that the furnace is online and carries out its intended function of flowing a hydrocarbon therethrough and cracking it. On the other hand, the term "a furnace is offline" means that the furnace is offline and no hydrocarbon flows therethrough to crack it.

Referring now to FIG. 1, there is shown a schematic of a typical ethylene furnace 10. An ethylene furnace 10 consists of a radiant section 12 and a convection section 14 which usually sits on the top of radiant section 12 in a chair configuration. Radiant section 12 is where heat for the process is provided by firing a fuel 18. Flue gases exiting radiant section 12 are sent to convection section 14 to recover heat. Radiant section 12 contains a number of radiant tubes where the hydrocarbon cracking reaction occurs. Convection section 14 contains a number of tube banks with each bank having a specific heat function. Typically a top bank 56 in convection section 14 heats hydrocarbon feed 24. A second bank 58 from the top heats a utility boiler feed water 60 which is sent to a steam drum 62 located high in the furnace 10 structure. A third bank 64 from the top heats hydrocarbon and dilution steam mixture 66 which is sent to a fifth bank 68 for further heating. A fourth bank 70 from the top receives steam from steam drum 62 and superheats to predetermined temperature to make utility high pressure steam 42 and sent it to utility system. Fifth bank 68, being the lowest in convection section 14, heats hydrocarbon and steam mixture 66 to incipient reaction temperature which is also called cross over temperature ("XOT") 74. Hydrocarbon and steam mixture 66 at cross over temperature 74 enters radiant section 12 where cracking reaction occurs. Cracked hydrocarbons and steam mixture from radiant coils is quickly quenched in transfer line exchanger 34 which sits directly on the top of radiant section 12. Radiant coil outlet temperature ("COT") 20 is a key process parameter which is used to control firing in radiant section 12. The banks of convection section 14 could be designed for different services.

FIG. 1 also shows key valving configurations. Top bank 56 in the convection section 14 which primarily heats hydrocarbon feed is also designed to heat dilution steam and/or air during decoking phase. As a result, a valve (S2) 80 in a steam line 27 is normally closed during cracking operation. During decoking, valve (S2) 80 is opened and valve (F1) 25 is closed to stop the flow of hydrocarbon 24. Dilution steam main flow 26 during cracking is added to hydrocarbon feed 24 at the inlet of third bank 64 in convection section 14. A sulfur injection piping 86 through a valve (C1) 88 is provided to add appropriate amount of sulfur compounds during cracking as well as sulfiding. During decoking, valve (C1) 88 will remain shut.

FIG. 1 shows routing of cracked gas and steam mixture from outlet 36 of transfer line exchanger 34. During normal production, mixture of cracked gas and steam is sent to the recovery section by keeping valve (V1) 50 open and valve (V2) 52 closed. Steam and air mixture during decoking is routed to "decoke system" 54 by keeping valve (V1) 50 closed and valve (V2) 52 open. "Decoke system" (not shown) consists of decoke piping from valve (V2) 52, a knock out pot equipped with water spray or a wet or dry cyclone separator. Cyclone separates coke particles in furnace 10 effluent. The cleaned and cooled decoke gases are discharged to the atmosphere. Radiant boxes of modern furnaces are being designed to accept decoke gases from decoke system to burn coke particles. Steam-air decoking dry effluent will contain species nitrogen, oxygen and carbon dioxide. On the other hand, steam decoking dry effluent will contain species carbon monoxide, hydrogen and carbon dioxide.

Present invention addresses a very critical step of decoking an ethylene furnace 10. The decoking method described herein speeds up water-gas reaction in steam decoking method with the use of chemicals, while decoke effluents are routed off-line to "decoke system". The decoking method consists of employing optimum combination of process parameters steam flow rate, coil outlet temperature and chemical injection rate. This decoking method will be referred as steam-chemical decoking method. The steam-chemical decoking is controlled by adjusting COT 20, which is easy, since decoke reaction—water gas reaction—is endothermic. Methodology of steam-chemical decoking depends directly on the amount of coke to be removed from furnace 10 under decoking. The amount of coke to be removed in a furnace 10 is a function of the type of hydrocarbon feed, conversion or severity of operation and furnace run length. The following description of the decoking process is applicable to any ethylene furnace 10. Typical steam-chemical decoke operating process parameters are given in Examples 1 below.

First step in this methodology is to calculate amount of coke that has been deposited in the furnaces during the entire run. The amount of coke lay down in furnace tubes is calculated using hydrocarbon feed type, hydrocarbon feed rate to furnace 10, feed conversion or cracking severity, dilution steam to hydrocarbon ratio and number of days furnace ran (furnace run length).

Theoretical amount of decoke steam required for the water-gas reaction can be calculated for the amount of coke deposited in furnace 10. Actual amount of steam is a multiple of theoretical amount of steam. Then hourly decoke steam flow rate is the amount of actual steam divided by the number of hours planned for decoke. However, the maximum hourly decoke steam flow rate should not exceed mass velocity of 60 kg/m2-sec. Also decoke steam velocity at the coil outlet should be less than 200 msec.

Coil outlet temperature 20 used in steam-chemical decoke should be sufficiently high to allow for the gasification of coke and, preferably, in the range of 825 to 900° C., which is easily achievable in all types of furnaces.

The chemical mixture to be injected consists of an aqueous solution of potassium hydroxide (KOH) and potassium carbonate ($K_2CO_3$). Aqueous solution should have concentration of no more than 10 wt %, preferably 2 wt %. The amount of potassium hydroxide (KOH) in the potassium hydroxide (KOH)—potassium carbonate ($K_2CO_3$) mixture could range from 0 to 50 wt %, normally 10%. Chemicals to be used are not limited to these two compounds as many more choices are available. For example, other hydroxides of metals from group 1 (Li, Na, K, Rb, Cs or Fr) or group 2 (Be, Mg, Ca, Sr, Ba or Ra) of the periodic table may be used instead of potassium hydroxide. LiOH is an example of such hydroxide. Also, other carbonates of metals from group 1 or group 2 of the periodic table may be used instead of potassium carbonate ($K_2CO_3$).

The decoke steam flow rate calculated above is normally higher than the dilution steam flow rate used in normal cracking Decoke coil outlet temperature of 900° C. is higher than that used in normal cracking operation. Therefore when furnace run is stopped by cutting off hydrocarbon feed and operates in hot steam stand by (HSSB) stage, steam flow rate should be adjusted to decoke steam flow rate and coil outlet temperature should be increased to 900° C. Referring to the FIG. 1, decoke steam is made of dilution steam flow and additional steam routed to top convection bank by opening valve (S2) 80 (with valve (F1) 25 being closed).

Furnace 10 is now ready for decoking with chemical injection. A sulfur compound is injected into dilution steam via valve (C1) 88 during normal cracking and sulfiding. Sulfur injection is not used during decoking and valve (C1) 88 is closed. During decoking, the sulfur injection point can be used to inject aqueous solution of potassium hydroxide (KOH) and potassium carbonate ($K_2CO_3$) by providing additional piping and a valve (C2) 90 as shown in the FIG. 1. Rate of aqueous solution of potassium hydroxide (KOH) and potassium carbonate ($K_2CO_3$) injection via valve (C2) 90 is predetermined and ranges from 50 ppmw to 1000 ppmw, preferable 250 ppmw, based on the total decoke steam flow rate.

About one third (⅓) of the planned decoke time is performed at fixed conditions of decoked steam flow, coil outlet temperature and chemical injection rate. This decoking period removes majority of coke in radiant coils as well as transfer line exchangers. To remove last traces of coke, decoke steam flow rate is reduced in two steps to provide somewhat longer reaction time for steam and chemical to react with coke. For the next one third (⅓) period, decoke steam flow rate is reduced to halfway between decoke steam flow rate and cracking dilution steam flow rate. For the last one third (⅓) period decoke steam flow rate is reduced to equal cracking dilution steam flow rate. coil. During the last one third (⅓) period, decoke effluent CO concentration will be less than 0.1 mole % on dry basis. In the last one third (⅓) period transfer line exchanger 34 outlet temperature will come to a constant value which will be an indication to terminate decoking.

Many times furnace 10 contains coils which are more coked than others. In steam-chemical decoke method described above chemical injection rate is an independent variable. As a result if needed chemical injection rates can be adjusted to match coking degree of each coil.

At the end of decoking period, furnace 10 is already operating at cracking dilution steam flow rate. Decoking can be ended by closing valve (V2) 52 and opening valve (V1) 50 to run furnace 10 in HSSB mode. Since no sulfiding is required, HSSB period is short and furnace 10 can be put into production as soon as COT 20 is brought down to cracking COT 20 (close valve (S2) 80 and open valve (F1) 25).

Throughout the entire decoking period transfer line exchanger 34 outlet temperature will remain higher than 350° C. in most of the furnace designs. Since chemical mixture selected above can gasify coke at temperatures as low as 350° C., TLE's will be cleaned to a large degree. This is in contrast to steam-air decoking where no combustion of coke occurs at such a low Transfer line exchanger operating temperatures. Similarly, many furnaces have observed coking in convection bank 68 where hydrocarbon and steam mixture is heated to final incipient reaction temperature. Chemical mixture selected above will gasify coke fouling in convection bank 68. In summary, the steam-chemical decoke method presented in this invention can provide superior cleaning of the entire furnace 10 compared to currently popular steam-air decoke method. Other advantages of steam-chemical decoking such as low carburization, no sulfiding etc are already discussed above.

Above description of preferred embodiments provides process parameters for steam-chemical decoke method, i.e. decoke steam flow rate, coil outlet temperature and chemical injection rate. Those skilled in the art will recognize that the preferred embodiment of invention described herein and the decoke process parameters derived can be applied to all furnaces. Those skilled in the art can easily develop decoke process parameter matrix as described in the description of the preferred embodiments above. Finally those skilled in the art can use the teaching to adjust the steam-chemical decoke process parameters to achieve best decoking possible for their furnaces. The following example further illustrates the invention but is not to be construed as limitations on the scope of the process and apparatus contemplated herein.

Example 1 provided below describes steam-chemical decoking process as can be performed in any typical ethylene furnace 10. The steam-chemical decoking process is a modification of the old steam-only decoking process to reflect water-gas reaction synergy provided by the chemical mixture.

EXAMPLE 1

All the following steps are summarized in the Table 1 below. Furnace 10 is cracking at dilution steam flow rate of 20,000 kg/hr and coil outlet temperature of 825° C. Furnace 10 is ready for decoking. Based on furnace run length, hydrocarbon type and cracking severity, coke calculation showed a need to decoke furnace 10 using a decoke steam flow rate of 28,000 kg/hr. Decoke steam flow rate was equivalent to mass velocity of about 45 kg/m2-sec and velocity of about 170 m/sec. Mechanical design of furnace 10 dictated that the coil operating temperature should be limited to about 875° C. during decoking phase.

Furnace operation is changed to run in HSSB mode by closing valve (F1) 25. Then valve (S2) 80 is opened and 8,000 kg/hr of steam is admitted. The fuel firing is continually adjusted to maintain COT 20 of 825° C. This phase should take no more than 15 minutes. Total decoke steam flow rate now is 28,000 kg/hr as desired. With total decoke steam flow rate at 28,000 kg/hr, fuel firing is ramped up to increase COT 20 at the rate of 100° C. per hour. Once furnace 10 is operating at 28,000 kg/hr and 875° C. it is ready for decoking Furnace 10 is moved into decoking phase by closing valve (V1) 50 and opening valve (V2) 52. Some furnaces have both valves synchronized automatically.

Decoking Step 1: Decoking starts when aqueous chemical solution is injected by opening valve (C2) 90 while valve (C1) 88 is closed. Chemical injection rate is 250 ppmw based on total decoke steam flow rate of 28,000 kg/hr. Decoke Step 1 has a duration of 12 hours. Significant amount of decoking will be finished in this step. Decoke effluent should have CO content of less than 1.0 mole % on dry basis.

Decoking Step 2: Furnace decoking is continued with lower decoke steam flow rate of 24,000 kg/hr and COT of 875° C. This is to provide longer reaction time in colder parts of furnace 10 such as transfer line exchanger 34 tubes. Furnace 10 firing is controlled so that COT 20 is maintained at 875° C. In almost all furnace designs transfer line exchanger 34 outlet temperature will be above 350° C. at 24,000 kg/hr decoke steam flow and COT 20 of 875° C. Decoke effluent CO content will reduce to less than 0.1 mole % on dry basis.

Decoking Step 3: Furnace 10 decoking is continued with lower decoke steam flow rate of 20,000 kg/hr and COT 20 of 875° C. Again the lower steam flow rate will provide longer reaction time in colder parts of furnace 10. By now transfer line exchanger 34 outlet temperature should stabilize which is an indication of decoke termination.

Furnace decoking is now complete and furnace 10 can be changed to run in HSSB mode. Furnace 10 effluent routing is switched from decoke system to recovery system by closing valve (V2) 52 and opening valve (V1) 50. There is no more need of decoke chemical so valve (C2) 90 is closed and valve (C1) 88 is opened. Also, as additional flow of decoke steam is not required, valve (S2) 80 is closed. Furnace 10 operating conditions are adjusted for HSSB conditions to dilution steam flow rate of 20,000 kg/hr and COT 20 is lowered to cracking COT 20 of 825° C. Firing is controlled so that COT 20 is reduced at the rate of 50° C./hr. When HSSB furnace 10 operating conditions reach 825° C. furnace 10 is ready for production. There is no need of sulfiding before starting production.

TABLE 1

Process Parameters for a Furnace

| Phase | Note | Step | Duration hours | Cumulative Hours | Dilution steam Kg/h | Chemical Injection ppmw | COT ° C. | TLX T (out) ° C. | Valve (V1) | Valve (V2) |
|---|---|---|---|---|---|---|---|---|---|---|
| Cracking | | | | | 20,000 | | 825 | | open | closed |
| HSSB | a | | | | 28000 | | 875 | | open | closed |
| Decoking | b | 1 | 12 | 12 | 28,000 | 250 | 875 | >350 | closed | open |
| Decoking | c | 2 | 12 | 24 | 24,000 | 250 | 875 | >350 | closed | open |
| Decoking | d | 3 | 12 | 36 | 20,000 | 250 | 875 | >350 | closed | open |
| HSSB | e | | | | 20,000 | | 825 | | open | closed |
| Cracking | f | | | | 20,000 | | 825 | | open | closed |

Notes a Rate of change of COT 20 should be 100° C. per hour b Inject chemical only after valve (V1) 50 is completely closed c Reduce decoke steam flow rate slowly while maintaining COT 20 of 875° C.

d Reduce decoke steam flow rate slowly while maintaining COT 20 of 875° C.

e Control firing to lower COT 20 at the rate of 50° C. per hour.

It should be understood that although the process above is described as a three step process of reducing the decoke steam flow rate, the process disclosed herein in accordance with the invention can be practiced without varying the decoke steam rate whereby the process is carried out without reducing the decoke steam flow rate during the process. It is preferred, however, that the rate of the decoke steam flow rate be reduced at least once during the process to provide longer reaction time in colder parts of furnace 10 such as transfer line exchanger 34 tubes to effect the removal of deposits therefrom.

In an alternative embodiment of the present invention, the process is used when the furnace is online and is, especially effective when an ethylene furnace is first decoked offline using the method of the present invention and then, it is placed online. In that mode of decoking, the chemical mixture of metal hydroxide and metal carbonate is injected into the hydrocarbons being cracked. The ethylene furnace would be able to crack hydrocarbons with the chemical mixture at levels of 10 to 50 ppmw on feed to gasify coke formed during process thereby extending furnace run length.

It should be understood that the preferred embodiments of the invention as described above including Example 1 is not intended to limit the invention and the parameters describe the preferred embodiments of the invention. While specific embodiments of the present invention have been described above, one skilled in the art will recognize that numerous variations or changes may be made to the process described above without departing from the scope of the invention as noted in the appended claims.

What is claimed is:

1. A process for decoking an ethylene furnace, comprising the steps of:

(a) supplying a mixture of steam and predetermined chemical amount at pre-calculated radiant coil outlet temperature by controlling furnace firing;

(b) decreasing the flow of steam and while maintaining radiant coil temperature and chemical injection rate; and (c) further decreasing the flow of steam while maintaining radiant coil temperature and chemical injection rate until furnace de-coking is complete.

2. The process of claim 1, further comprising the steps of:

calculating quantity of steam and chemical mixture to provide sufficient reaction time in the furnace as a function of radiant coil outlet temperature; and determining feasible operating radiant coil temperature for decoking.

3. The process of claim 1, wherein in the step (a) the radiant coil outlet temperature is about 850° C. to 900° C., depending on the furnace mechanical design, and in the step (b) and step(c) the radiant coil temperature is same as that in step (a).

4. The process of claim 2, further comprising the step of adjusting chemical injection rate into steam to increase coke gasification rate.

5. The process of claim 1, wherein in the step (a) the steam flow rate in the radiant coils is at a velocity less than 200 m/sec.

6. The process of claim 1, wherein in the step (a) the steam flow rate in the radiant coils has a mass velocity less than 60 kg/m2-sec.

7. The process of claim 1, wherein in the step (a), step (b) and step(c), the chemical is an aqueous solution of KOH and of $K_2CO_3$.

8. The process of claim 1, wherein in the step (a), step (b) and step(c), the chemical is an aqueous solution that contains KOH—$K_2CO_3$ mixture and the amount of up to 50 wt% KOH.

9. The process of claim 1, wherein in the step (b), step (b) and step (c) chemical injection rate provides from 10 to 1000 ppmw chemical mixture based on steam flow rate.

10. The process according to claim 1, wherein in the step (a), step (b) and step (c), the chemical contains a hydroxide of a metal selected from group 1 or group 2 of the periodic table.

11. The process according to claim 10 wherein the metal hydroxide is selected from the group of KOH or LiOH.

12. The process according to claim 1, wherein quench exchanger outlet temperature is maintained at temperature above 350° C.

13. A method of decoking an ethylene furnace which is used for the cracking of a hydrocarbon, comprising the steps of:

maintaining a temperature suitable for allowing the gasification of coke;

contacting the furnace with steam and a mixture of a metal hydroxide and a metal carbonate; and decreasing the flow of steam and while maintaining radiant coil temperature and chemical injection rate.

14. The method according to claim 13 wherein the metal that is present in the metal hydroxide or in the metal carbonate is a metal from group 1 (Li, Na, K, Rb, Cs or Fr) or group 2 (Be, Mg, Ca, Sr, Ba or Ra) of the periodic table.

15. A method according to claim 13 wherein the step of contacting the furnace with steam and a mixture of a metal hydroxide and a metal carbonate is carried simultaneously with the step of cracking the hydrocarbon.

16. A method according to claim 13 wherein the step of contacting the furnace with steam and a mixture of a metal hydroxide and a metal carbonate is carried out when the furnace is offline and no step of cracking is carried out in the furnace.

17. A method according to claim 13 wherein the step of contacting the furnace with steam and a mixture of a metal hydroxide and a metal carbonate is carried out for a time which is sufficient to remove the coke from the furnace.

* * * * *